US012012135B2

(12) United States Patent
Abrosimov et al.

(10) Patent No.: US 12,012,135 B2
(45) **Date of Patent: *Jun. 18, 2024**

(54) VEHICLE WARNING SYSTEM

(71) Applicant: Westinghouse Air Brake Technologies Corporation, Pittsburgh, PA (US)

(72) Inventors: Igor Abrosimov, N. Potomac, MD (US); Daniel McGee, Alexandria, VA (US)

(73) Assignee: Westinghouse Air Brake Technologies Corporation, Pittsburgh, PA (US)

( * ) Notice: Subject to any disclaimer, the term of this patent is extended or adjusted under 35 U.S.C. 154(b) by 553 days.

This patent is subject to a terminal disclaimer.

(21) Appl. No.: 17/228,132

(22) Filed: Apr. 12, 2021

(65) Prior Publication Data

US 2021/0229715 A1 Jul. 29, 2021

Related U.S. Application Data

(63) Continuation-in-part of application No. 16/206,349, filed on Nov. 30, 2018, now Pat. No. 11,001,284.

(51) Int. Cl.
*B61L 23/34* (2006.01)
*B61L 25/02* (2006.01)

(52) U.S. Cl.
CPC ..... *B61L 23/34* (2013.01); *B61L 25/02* (2013.01)

(58) Field of Classification Search
CPC ..... B61L 23/34; B61L 25/02
See application file for complete search history.

(56) References Cited

U.S. PATENT DOCUMENTS 9,275,544 B2 3/2016 Levine et al.
2006/0015224 A1* 1/2006 Hilleary ..... B61L 29/00 701/19
2011/0098915 A1 4/2011 Disatnik et al.
(Continued)

FOREIGN PATENT DOCUMENTS

CN 106515797 B 4/2018

OTHER PUBLICATIONS

WAZE "Driving Directions, Traffic Reports & Carpool Rideshares by Waze", https://www.waze.com/waze (8 pages).
(Continued)

*Primary Examiner* — Peter D Nolan
*Assistant Examiner* — Wae L Louie
(74) *Attorney, Agent, or Firm* — K&L Gates LLP

(57) ABSTRACT

A vehicle warning system and method receive an information notification from a first vehicle system at a second vehicle system. The information notification includes traversal information associated with a position of the first vehicle system and/or an identifier associated with the first vehicle system. The information notification also including a warning that indicates of the second vehicle system is moving too close to the first vehicle system and/or the first vehicle system and the second vehicle system are headed toward an intersection. A decision is made as to whether a response should be sent based on the information notification and sending the response based on the information notification to the first vehicle system. The response includes a command to slow down or stop to avoid a collision with the first vehicle system.

20 Claims, 6 Drawing Sheets

(56) References Cited

U.S. PATENT DOCUMENTS

| | | | | |
|---|---|---|---|---|
| 2012/0315916 | A1* | 12/2012 | Van Phan | H04W 36/08 455/442 |
| 2014/0257748 | A1* | 9/2014 | Lundquist | G01B 7/003 702/150 |
| 2015/0302752 | A1* | 10/2015 | Holihan | B61L 23/26 246/62 |
| 2016/0046308 | A1* | 2/2016 | Chung | B61L 27/20 701/20 |
| 2017/0148323 | A1* | 5/2017 | Shubs, Jr. | B61L 27/10 |
| 2018/0037241 | A1* | 2/2018 | Sharma | B61L 15/0058 |
| 2018/0065650 | A1* | 3/2018 | Plotnikov | B61L 3/08 |
| 2018/0222505 | A1* | 8/2018 | Chung | B61L 27/14 |
| 2018/0237039 | A1* | 8/2018 | Mong | B61L 23/005 |
| 2019/0114914 | A1* | 4/2019 | Gao | B61L 25/025 |
| 2019/0322299 | A1* | 10/2019 | Mong | B61L 15/0072 |
| 2020/0172133 | A1* | 6/2020 | Abrosimov | B61L 15/0027 |
| 2020/0172134 | A1* | 6/2020 | Kernwein | G06V 20/52 |

OTHER PUBLICATIONS

Examiner's Requisition from CIPO dated Aug. 1, 2023 for corresponding Canadian Patent Application No. 3,047,274 (5 pages).

* cited by examiner

VEHICLE WARNING SYSTEM

CROSS-REFERENCE TO RELATED APPLICATIONS

This application is a continuation-in-part of U.S. patent application Ser. No. 16/206,349, which was filed 30 Nov. 2018, and the entire disclosure of which is incorporated herein by reference.

BACKGROUND

Technical Field

The present invention relates generally to systems and methods of vehicle-to-vehicle warnings via a communication system between a first communication device in a first vehicle and a second communication device in a second vehicle, and, in particular, safety methods of warning a vehicle operator using a vehicle-to-vehicle warning.

Discussion of Art

There is a growing movement to transport more material by rail as production of goods reaches capacity. Additional and improved safety systems are required to solve problems in current systems. Thus, there are efforts to improve the safety of systems used to determine the health of a train, including end of train devices. An end of train device is generally armed by a railway engineer to a head of train device to provide a safe and reliable connection between the locomotive and the end of the train.

Currently, the head of train device in the locomotive communicates with the end of train device that is coupled to the last car of the train via messages over a UHF RF link. An AAR standard process (termed the "arming process") is executed prior to the train's departure to pair the head of train device to the end of train device that is on the same train. When the head of train device is "armed" to an end of train device, it only processes the messages from the paired end of train device. Additionally, the current head of train device requires a railway engineer to directly access parameters, displays, and buttons on the end of train device. Additionally, to arm the end of train device, a person must place themselves in an unsafe position on the railway to straddle or stand on a middle of a track behind an end of train railcar to press a button or to view displays on the end of train device. In some non-limiting embodiments or aspects, an end of train device display can be difficult to view from longer distances and/or can be distorted by bright ambient light.

In certain railroad and train control and management systems (e.g., Positive Train Control (PTC) system, the I-ETMS® of Wabtec Corp., etc.), enforcement of conditional authorities is required in order to prevent a train from entering an unauthorized section of track until the condition for making the authority effective has occurred. In one exemplary embodiment of an existing system, the location of the named trains (referred to as "identifying trains") in the conditional authority are confirmed by the train crew via a prompt or similar interaction from a PTC system on the display of the on-board computer on the locomotive. The terms "identifying train" or "identifying locomotive" refer to the train or locomotive listed in the movement authority dataset of a conditional authority as being in the lead of one of the trains for which the train holding that authority must wait. Assuming the crew answers the prompt correctly, the appropriate protection between trains is achieved. However, in some situations, the crew may respond incorrectly, assuming a train has passed when, in reality, it has not. This creates a situation where the authority of the train or trains named in the conditional authority may be violated, possibly resulting in a collision. The Federal Railroad Association has expressed its concern regarding this potential hazard.

Current PTC systems may not be capable and/or configured to receive a train's location (e.g., train location data, location data, etc.) other than from a remote server (e.g., dispatcher, central office, back office, etc.). When the remote server fails and/or does not otherwise send a location update, the PTC system may not be capable and/or configured to efficiently receive and/or generate accurate location data about any other trains in a geographic location (e.g., on the same track, in siding, etc.). In addition, when the remote server fails and/or does not otherwise send a location update, the PTC system may not be capable and/or configured to efficiently and/or safely receive timely indications (e.g., alerts, warnings, updates, etc.) that the trains are running too close together. In addition, when the remote server fails and/or does not otherwise send a location update, the PTC system may not be capable and/or configured to efficiently and/or safely determine any other train in the railway for safe passage without visual evaluation and a speed reduction (e.g., a speed target, warning, etc.).

BRIEF DESCRIPTION

In one example of the subject matter described herein, a method is provided that includes receiving an information notification from a first vehicle system at a second vehicle system. The information notification includes traversal information associated with a position of the first vehicle system and/or an identifier associated with the first vehicle system. The information notification also including a warning that indicates of the second vehicle system is moving too close to the first vehicle system and/or the first vehicle system and the second vehicle system are headed toward an intersection. The method also includes determining that a response should be sent based on the information notification and sending the response based on the information notification to the first vehicle system. The response includes a command to slow down or stop to avoid a collision with the first vehicle system.

In another example of the subject matter described herein, a system includes a communication device configured to be disposed onboard a first vehicle system. The communication device is configured to receive an information notification from a second vehicle system. The information notification includes traversal information associated with a position of the second vehicle system and/or an identifier associated with the second vehicle system. The information notification can include a warning that indicates the first vehicle system is moving too close to the second vehicle system (e.g., the vehicle systems are within a threshold distance of each other or will be within the threshold distance of each other within a designated period of time if the vehicle systems continue moving on current headings and at current speeds). Optionally, the information notification can additionally or alternatively indicate that the first vehicle system and the second vehicle system are headed toward an intersection. The system also includes one or more processors configured to determine that a response should be sent to the second vehicle system based on the information notification. The one or more processors are configured to direct the communication device to send the response based on the information notification. The response includes a command to slow down or stop to avoid a collision with the first vehicle system.

In another example of the subject matter described herein, a method includes monitoring movement of a rail vehicle system along a track, monitoring movement of a non-rail vehicle system along a route that intersects the track, determining (onboard the rail vehicle system and/or the non-rail vehicle system) whether the movement of the rail vehicle system and the movement of the non-rail vehicle system will result in the rail vehicle system and the non-rail vehicle system occupying an intersection between the track and the route at a same time, and communicating a signal from the one or more of the rail vehicle system or the non-rail vehicle system to another of the one or more of the rail vehicle system or the non-rail vehicle system. The signal instructs at least one of the rail vehicle system or the non-rail vehicle system to stop, slow down, or move onto another track or another route.

BRIEF DESCRIPTION OF THE DRAWINGS

The inventive subject matter may be understood from reading the following description of non-limiting embodiments, with reference to the attached drawings, wherein below.

DETAILED DESCRIPTION

Figure 1:
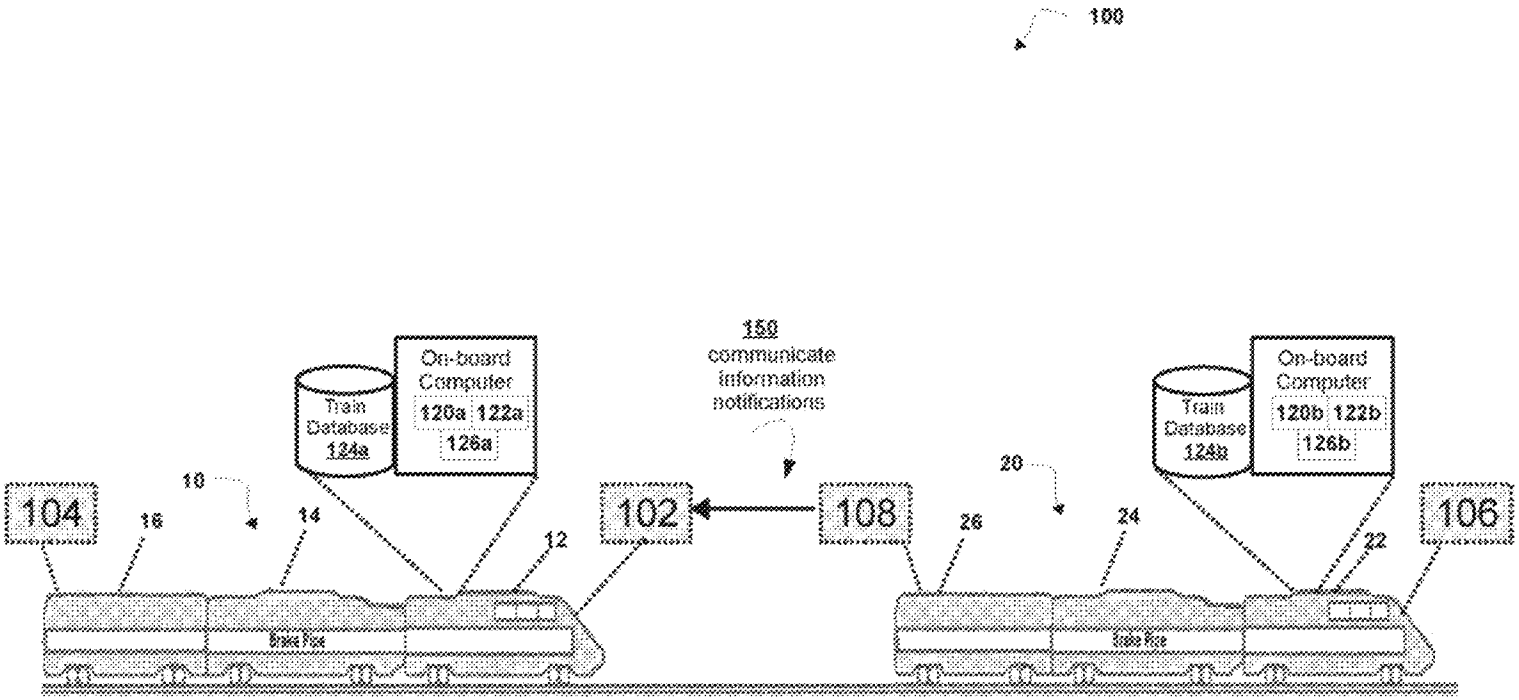
FIG. 1 illustrates one embodiment of a train-to-train warning system.

As disclosed herein, in some non-limiting embodiments, a computer-implemented train-to-train warning method may include: receiving, by a head of train computer of a listener train, an information notification originating from an end of train device associated with a first train in a geographic area, the information notification including at least one of traversal information associated with a position of the first train in a track network or an identifier associated with the first train, identifying the first train based on at least one of the position of the first train or the identifier associated with the first train, determining, by an on-board computer having one or more processors in the listener train, one or more event or conditions of the first train in the track network based on the information notification; generating an updated operation of the listener train including one or more actions, the updated operation based on the one or more event or conditions associated with the first train; and controlling, by the on-board computer, a movement of the listener train based on at least one of the one or more actions. As described herein, not all embodiments of the inventive subject matter are limited to train-to-train communications. One or more embodiments can be used for communications between other types of vehicles, such as between a rail vehicle and a non-rail vehicle, between non-rail vehicles, and the like. For example, the inventive subject matter may be used for trains to warn automobiles, trucks, mining vehicles, or the like, and/or for automobiles, trucks, mining vehicles, or the like, to warn trains.

In this way, a train-to-train warning method includes receiving traversal information associated with a position of any train in the railway (e.g., receive from an end-of-train (EOT) device a train's location, etc.) other than from a remote server (e.g., dispatcher, central office, back office, etc.) via a communication link between a head-of-train (HOT) device and an EOT device. Accordingly, a train-to-train warning method reduces or eliminates a processing delay associated with a positive train control (PTC) system not receiving (e.g., efficiently receiving and/or reporting accurate location data about any other trains on the same track and/or siding associated with the track). Additionally, and/or alternatively, the train-to-train warning method includes receiving timely indications (e.g., alerts, warnings, updates, etc.) to efficiently and/or safely report any other trains in the railway running too close (e.g., within a threshold of a listener train, etc.). In addition, the train-to-train warning system may be capable and/or configured to efficiently and/or safely determine any other train in the railway for safe passage without visual evaluation and a speed reduction. For example, the train-to-train warning system is capable and/or configured to efficiently and/or safely determine any other train in the railway when the remote server fails and/or does not otherwise send a location update.

It is to be understood that the invention may assume various alternative variations and step sequences, except where expressly specified to the contrary. It is also to be understood that the specific products, systems, and processes illustrated in the attached drawings, and described in the following specification, are simply exemplary embodiments of the invention. Hence, specific dimensions and other physical characteristics related to the embodiments disclosed herein are not to be considered as limiting. As used herein, the singular form of "a", "an", and "the" include plural referents unless the context clearly dictates otherwise.

As used herein, the terms "communication" and "communicate" refer to the receipt, transmission, or transfer of one or more signals, messages, commands, or other types of data. For one unit or device to be in communication with another unit or device means that the one unit or device is able to receive data from and/or transmit data to the other unit or device. A communication may use a direct or indirect connection and may be wired and/or wireless in nature. Additionally, two units or devices may be in communication with each other even though the data transmitted may be modified, processed, routed, etc., between the first and second unit or device. For example, a first unit may be in communication with a second unit even though the first unit passively receives data and does not actively transmit data to the second unit. As another example, a first unit may be in communication with a second unit if an intermediary unit processes data from one unit and transmits processed data to the second unit. It will be appreciated that numerous other arrangements are possible. Any known electronic communication protocols and/or algorithms may be used such as, for example, TCP/IP (including HTTP and other protocols), WLAN (including 802.11 and other radio frequency-based protocols and methods), analog transmissions, Global System for Mobile Communications (GSM), private wireless, public wireless, 160/220/900 MHz VHF, WiFi, UHF 452-458 MHz, WiMAX, Cellular 3G/4G/5G, omni-directional, and/or the like.

FIG. 1 is a diagram of a non-limiting embodiment of a train-to-train warning system 100 in which systems and/or methods, described herein, can be implemented. As shown in FIG. 1, train 10 includes a locomotive 12, one or more railcars 14, and an end of train railcar 16. Systems and/or devices of train-to-train warning system 100 can interconnect via wired connections, wireless connections, or a combination of wired and wireless connections.

With continued reference to FIG. 1, a preferred and non-limiting embodiment or aspect of a train-to-train warning system 100 may include a HOT device 102 (e.g., a locomotive control unit (LCU), head of train unit, etc.) located in or associated with the locomotive 12 of the train 10. In some non-limiting embodiments, the HOT device 102 is mounted to the train operator's console in the locomotive 12. In some non-limiting embodiments or aspects, the HOT device 102 may be connected to an EOT device (e.g., radio telemetry systems, end of train unit, etc.) on a railcar 16, typically the last railcar, in the train 10. For example, the EOT device 104 is mounted to the end of train railcar 16, the EOT device 104 is coupled to the brake pipe by means of a hose and a glad hand.

The EOT device 104 can transmit data pertaining to the pressure in the brake pipe and the motion of the last railcar to the HOT device 102 via radio signal. To accomplish this, the EOT device 104 includes a position sensor to sense location and/or heading of the railcar, a motion sensor to sense movement of the railcar, a pressure transducer to monitor brake pipe pressure, a microprocessor unit to control the overall operation of these components, and a transmitter that the microprocessor unit uses to transmit this last railcar data. In the locomotive 12, the HOT device 102 includes a receiver to receive transmissions from the EOT device 104, a primary display, and a microprocessor unit to direct the operation of these components.

The EOT device 104 can include a positioning (e.g., navigation, mapping, etc.) system (e.g., a global positioning (GPS) or global navigation satellite system (GNSS) receiver and antenna, at least one wheel tachometer/speed sensor, magnetic compass for orientation, and/or the like). The positioning system may be programmed or configured to sense or determine a location or position of a portion of the train.

The EOT device 104 may be programmed to determine or receive a location or position of at least a portion of the train based at least partially on the location or position sensed or determined by the at least one positioning system.

The EOT device 104 may be programmed or configured to generate or receive an information notification based at least partially on the location or position sensed or determined by the at least one positioning system.

The HOT device 102 may be programmed or configured to generate or receive an information notification based at least partially on the location or position sensed or determined by the at least one positioning system.

The HOT device 102 can continuously or otherwise repeatedly update the train operator with the status of operations at the rear of the train. More notably, if a potentially dangerous situation arises such as the brake pipe pressure plunges suddenly or drops below a predetermined level, the HOT device 102 operates to warn the train operator that an emergency condition exists at the rear of the train. The emergency brake application can start at the locomotive and progress along the brake pipe to the last railcar. The emergency brake application can start at the locomotive and the last railcar.

The EOT device 104 and the HOT device 102 can each be equipped with a transceiver (e.g., combination transmitter and receiver, separate transceiver and receiver, etc.). The EOT device 104 also can have an emergency brake valve that is controlled by its microprocessor unit, and the HOT device 102 also can include an emergency toggle switch. By toggling this switch in an emergency, the train operator can cause the HOT device 102 to transmit an emergency brake radio signal to the EOT device 104. The EOT device 104 can include a microprocessor unit, for example, to respond to an emergency signal by commanding its emergency brake valve to reduce the pressure in the brake pipe at an emergency rate.

The HOT device 102 can have a primary display panel which features a dedicated display for each of several types of last railcar data. The last railcar data displayed includes brake pipe pressure, low battery condition, whether the railcar is stopped or in motion, and whether an emergency has been enabled or disabled. The HOT device 102 also has a supplemental message display by which it visually conveys additional information such as, for example, data related to arming of the EOT system and whether or not the EOT device 104 and HOT device 102 are communicating properly.

A Service Interface Unit (SIU) can connect between the serial port of the HOT device 102 and the brake pipe on the locomotive 12. The SIU provides the HOT device 102 with the current brake pipe pressure. The HOT device 102 can automatically initiate a service brake application at the last railcar simultaneously with the service reduction in brake pipe pressure initiated from the locomotive 12. For example, the HOT device 102 in the locomotive 12 automatically transmits a service brake radio signal to the EOT device 104 when it detects a service reduction in brake pipe pressure via the SIU.

The EOT device 104 (e.g., microprocessor unit, CPU, etc.) can respond to a service brake signal by commanding the emergency valve of the EOT device 104 to reduce the brake pipe pressure from the last railcar at the same service rate as that ordered by the locomotive brake equipment at the head of the train. The HOT device 102 also can automatically transmit an emergency brake signal when an emergency reduction in brake pipe pressure has been initiated by brake equipment of the locomotive 12. The HOT device 102 can include an emergency toggle switch to transmit this emergency brake signal.

After railcars are coupled to the locomotive(s) to form a train and before that train is put into service, a train operator may need to arm (e.g., authorize, etc.) a HOT device 102 in the lead locomotive 12 to communicate with the EOT device 104 on the particular train 10. The arming protocol prevents a HOT device 102 on one train from being erroneously or maliciously used to apply the brakes on another train. To this end, the HOT device 102 includes a thumb wheel switch assembly and a nonvolatile memory in which an identification code unique to a particular EOT device 104 can be stored. With that EOT device 104 on the last railcar, only when the train operator sets the thumb wheel switches to correspond to the EOT identification code stored in its memory is the HOT device 102 authorized to communicate with the EOT device 104 on the train. The HOT device 102 retains in its memory the identification code for that particular EOT device 104 until armed for a different EOT device 104.

With continued reference to FIG. 1, one embodiment of a train-to-train warning system 100 may include one or more additional trains as shown in FIG. 1. By way of example, train 20 includes a locomotive 22, one or more railcars 24, and an end of train railcar 26. As shown by reference number 150 in FIG. 1, information notifications are communicated between train 10 and train 20. For example, systems and/or devices of train-to-train warning system 100 can communicate (e.g., connect, interconnect, transmit, receive, etc.)

between trains via wired connections, wireless connections, or a combination of wired and wireless connections.

The train 20 can include systems and devices similar to train 10, including a HOT device 106 (e.g., a locomotive control unit (LCU), head of train unit, etc.) located in or associated with the locomotive 22 of the train 20. The HOT device 106 can be mounted to the train operator's console in the locomotive. The HOT device 106 may be connected to an EOT device 108 (e.g., radio telemetry systems, end of train unit, etc.) on an end of train railcar 26. For example, the EOT device 108 is mounted to the end of train railcar 26.

The HOT device 102 can be armed to communicate with a different EOT device 104 (e.g., armed to a new HOT device, etc.) when a railroad employee pushes a test button on the new EOT device 104 to transmit a first arming signal. For example, the arming signal includes the identification code of the EOT device 104 along with a special message identifier and confirmation bit. When the HOT device 102 receives the transmission, the HOT device 102 can direct display of an ARM NOW message if the stored code differs from the identification code of the new EOT device 104. The HOT device 102 can include a COMM TEST/ARM button to initiate a status update request (SUR) (e.g., by manually pushing the on button within six seconds of the ARM NOW message being displayed, etc.). If the EOT device 104 receives the SUR within six seconds from the time the EOT test button was pushed, the EOT device 104 responds by transmitting a second authorization signal. This signal contains a special message identifier and confirmation bit. Upon receiving the response from the EOT device 104, and if the thumb wheel switches have been set to the identification code of the new EOT device 104, the HOT device 102 then displays the ARMED message and stores in its nonvolatile memory the identification code of the new EOT device 104 thereby overwriting the previously stored code.

The HOT device in the locomotive can communicate with a EOT device that is coupled to the last car of the train via messages over a UHF RF link. An AAR standard process (termed the "arming process") is executed prior to the train's departure to pair the HOT device to the EOT device that is on the same train. When the HOT device is "armed" to an EOT device, it only processes the RF messages from that EOT device, although it can still receive messages from other EOT devices. An RF signal of the EOT device is an omnidirectional broadcast, so the signal can be received by the HOT devices in trains that are trailing behind the EOT device in the railway.

The HOT device 102 can communicate with a different EOT device 108 without arming HOT device 102 to EOT device 108. For example, the HOT device 102 may be programmed or configured to receive an information notification (e.g., location update, location message, identity update, etc.) directly or indirectly from the EOT device 108 located in or associated with the end of train railcar 26. For example, the HOT device 102 may be programmed or configured to sense (e.g., listen, determine) information notifications from EOT device 108 located in or associated with train 20. For example, EOT device 108 may transmit an information notification (e.g., transmit an omnidirectional broadcast via an RF signal, etc.) programmed so that the signal can be received by HOT device 102 in train 10 that is trailing behind the EOT.

The systems and methods described herein may be implemented on or in connection with a train (e.g., train 10, train 20, etc.) with at least one locomotive 12 having an on-board computer (e.g., on-board computer 120*a*, 120*b*). For example, the on-board computer 120*a* of train 10 may be located at any position or orientation on the train. The on-board computer 120*a* (e.g., on-board controller, on-board computer system, train management computer, and/or the like) performs the calculations for the PTC system and includes a communication device 122*a* and a train database 124*a* populated with data and/or which receives specified data and information from other trains, remote servers, back office servers, central dispatch, and/or the like, where this data may include track profile data, train data, information about switch locations, track heading changes (e.g., curves, and distance measurements), train consist information (e.g., the number of locomotives, the number of cars, the total length of the train, and/or the like), and/or the like. The on-board computer 120*a* can include PTC functions (e.g., train management, computer displays, cab signal monitors, brake and systems interfaces, an event recorder, etc.). A HOT device is connected to the on-board computer by a wireless or wired connection.

The HOT device 102 may be programmed or configured to communicate an information notification directly or indirectly to an on-board computer 120*a* located in or associated with a locomotive 12 of the train 10.

The on-board computer 120*a* also can include or be in communication with the appropriate braking system and other software or programs to effectively implement the systems and methods described herein. The on-board computer 120*a* can receive real-time inputs from various locomotive control settings or components, including a positioning (e.g., navigation system, mapping system, etc.) system (e.g., a GPS or GNSS receiver, at least one wheel tachometer/speed sensor, and/or the like). Further, the on-board computer 120*a* includes or is in communication with a communication device 122*a* (e.g., a data radio, a communication interface, a communication component, and/or the like), which facilitates communication by or between locomotives 12 and/or the locomotive 12 and some remote server or computer system (e.g., a central controller, a back office server, a remote server, central dispatch, back office PTC components, various wayside devices, such as signal or switch monitors, other on-board computers in the railway system, etc.). Further, this communication may occur wirelessly or in a "hard wired" form, e.g., over the rails of the track. In addition, the on-board computer 120*a* includes or is communicating via a visual display device 126*a*, such as the operator's display in the cab of the locomotive 12, or visual display device 126*b* of locomotive 22. This visual display device 126*a* is used to present information and data to the operator of the train. The train database 124*a* includes information about switch locations, track heading changes (e.g., curves), and distance measurements, while the on-board computer 120*a* receives, from a remote computer (e.g., the back office server, etc.), train consist information (e.g., number of locomotives, cars, and total length of the train, etc.). Accordingly, the presently-invented system and methods can be effectively implemented and used by or on such a locomotive 12 having such an on-board computer 120*a* and associated components. Of course, it is envisioned that any type of train management system can be used within the context and scope of the present invention.

The on-board computer 120*a* can receive updates from some remote server or computer system (e.g., a central controller, a back office server, a remote server, central dispatch, dispatching system, communications server, back office PTC components, various wayside devices, such as signal or switch monitors, other on-board computers 120*a* in the railway system, etc.). For example, the on-board computer 120*a* receives updates from a back office server (e.g., remote server) about train 20 on the same track, with a timely indication that the trains are running too close together.

The on-board computer 120*a* may not receive and/or obtain an update from a back office (e.g., remote server) about train 20 on the same track that the trains are running too close together or may not obtain in a timely indication that the train 10 and train 20 are running too close together. The HOT device 102 may be programmed or configured to communicate an information notification directly or indirectly to the on-board computer 120*a* located in or associated with a locomotive 12 of the train 10, a timely indication that the train 10 and train 20 are running too close together. For example, the HOT device 102 may be programmed or configured to communicate an information notification directly or indirectly to the on-board computer 120*a* based on an information notification from EOT device 108 of train 20.

The HOT device 102 may be programmed or configured to communicate an information notification directly or indirectly to the on-board computer 120*a* located in or associated with a locomotive of the train 10, a timely indication that a train is waiting in siding and an end of train railcar's 16 position is not fully determined. For example, the HOT device 102 may be programmed or configured to communicate an information notification directly or indirectly to the on-board computer 120*a* located in or associated with locomotive 12 of the train 10 to provide a train-to-train warning that end of the train railcar 16 is located in the railway and provide an action (e.g., speed reduction for safe passage without visual evaluation and thus require speed reduction, speed restriction for visual evaluation, etc.).

The HOT device 102 may be programmed or configured to communicate a train-to-train warning directly or indirectly to an on-board computer 120*a* located in or associated with a locomotive of the train.

The train-to-train warning system 100 can determine a safe distance to maintain between a first train and a second train on the same track (e.g., from the back of the train, the front of the train, etc.). For example, train-to-train warning system 100 determines a safe distance for a train stopped around a curve and no longer in a visible condition.

The EOT device on a first train can broadcast the identification number and location information (e.g., latitude, longitude, speed, heading, location uncertainty, etc.) of the first train.

The HOT device on the second train can receive the broadcast from the EOT device, including a message from the first train, and extract the data from the message. The HOT device on the second train sends its own identification and location information and EOT device identification and location information to the on-board PTC associated with the first train. The on-board PTC reads the data and, using the train database (e.g., track location database), determines that both trains are on the same track.

The on-board PTC computer can calculate both the actual distance between the two trains as well as the safe distance between the two trains. The on-board PTC can command the second train to apply brakes to slow down or stop in order to avoid a potential collision with the first train.

The train-to-train warning system 100 can determine a safe entry into a railway yard. For example, another train may be on the same track that is not being properly handled by the dispatcher.

The EOT device on a train in the railway yard can broadcasts its identification number and location information (e.g., latitude, longitude, speed, heading, location uncertainty, etc.). The HOT device on the train heading into the railway yard can receive the broadcast from the EOT device, including a message from the train already in the railway yard, and extract the data from the message. The HOT device on the train heading into the railway yard can send its own identification and location information and the other train's EOT device identification and location information to the on-board PTC. The on-board PTC can read this data and, using the track location database, determine both trains are on the same track and calculates both the actual distance between the two trains as well as the safe distance between the two trains. The on-board PTC can communicate this information to the on-board PTC back office.

The on-board PTC can command the train outside the railway yard to apply the brakes to slow down or stop to avoid a potential collision with the train in the railway yard.

The on-board PTC back office can inform the dispatcher of the incoming train and any possible danger.

The train-to-train warning system 100 can determine an end of train (e.g., tail, rear, etc.) is in the railway (e.g., occupying a first railway and a portion of a second railway, sticking out, etc.), but not visible. For example, a train waiting in siding to let another train pass.

The train-to-train warning system 100 can determine an EOT device on a train in the siding broadcasting an identification number and location information (e.g., latitude, longitude, speed, heading, location uncertainty, etc.). The HOT device on the train heading down the tracks can receive the broadcast from the EOT device, including a message from the train in the siding and extracts the data from the message.

The HOT device can send its own identification and location information and the other train's EOT device identification and location information to on-board PTC. The on-board PTC can read the data, using the track location database, to determine a part of the train in the siding may be on tracks.

The on-board PTC can communicate this information to the back office PTC, such as, for example, commands brake application to slow down or stop (if needed) in order to avoid a potential collision.

The on-board PTC back office can request the operator of the train in the siding to move further forward in the siding.

The HOT device can be configured to pass messages to an on-board PTC having the entire database of any EOT device.

The on-board PTC can cross-reference the database to find out how to proceed by processing train-to-train warning notifications when a train is running too close, or running too fast.

The EOT device on the first train can broadcast its identification number and location information (e.g., latitude, longitude, speed, heading, location uncertainty, etc.).

The HOT device on the second train can receive the broadcast from the EOT device, including a message from the first train, and extracts the data from the message.

The HOT device on the second train can send its own identification and location information and the first train's EOT device identification and location information to the on-board PTC.

The on-board PTC can read this data and, using the train database 124*a*, calculate both the actual distance between the two trains as well as the safe distance between the two trains, and the on-board PTC commands the second train to apply brakes to slow down or stop (if needed) to avoid a potential collision with the first train.

Figure 2:
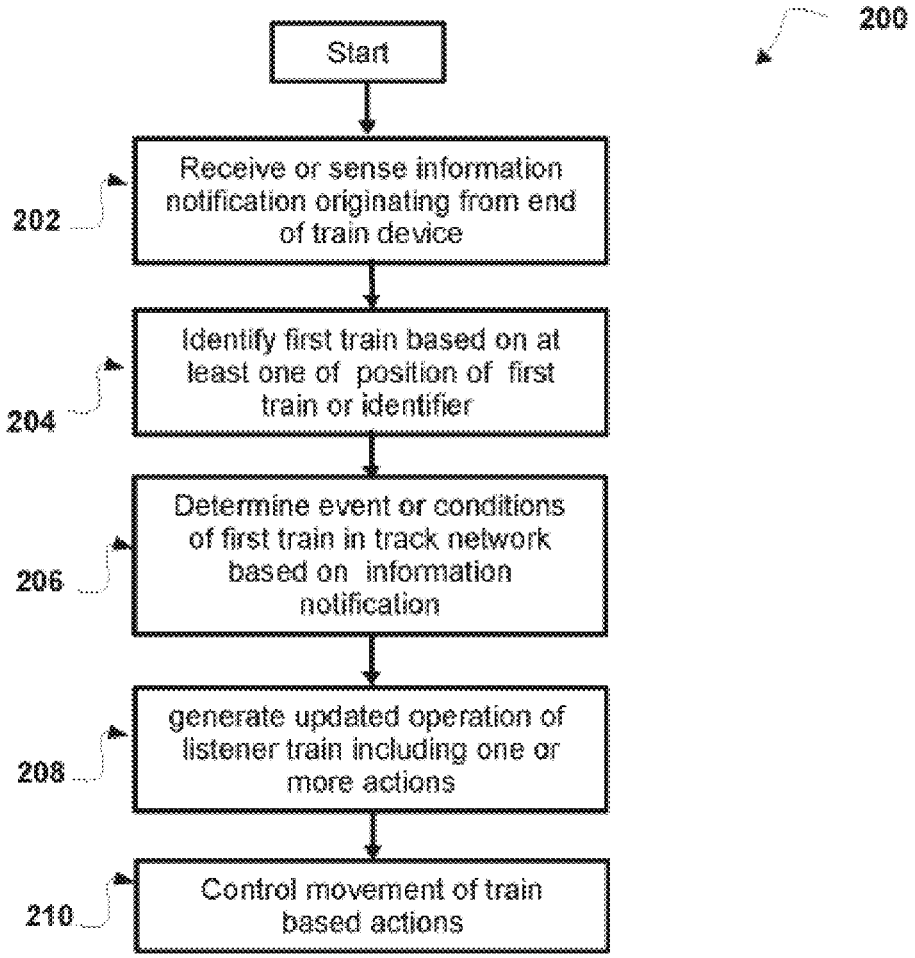
FIG. 2 illustrates a flowchart of an embodiment of a process for a train-to-train warning system.

FIG. 2 illustrates a flowchart of a process 200 for train-to-train warnings. One or more of the steps of process 200 can be performed (e.g., completely, partially, etc.) by HOT device 102, EOT device 104, and/or EOT device 108. One or more of the steps of process 200 can be performed (e.g., completely, partially, etc.) by another device or a group of devices separate from or including on-board computer 120*a* (e.g., one or more processors of on-board computer 120*a*, one or more components of on-board computer including communication device 122*a*, visual display device 126*a*, train database 124*a*, etc.), HOT device 102, EOT device 104, or a remote server 110 (e.g., one or more processors of remote server 110, etc.).

As shown in FIG. 2, at step 202, process 200 includes the HOT device 102 receiving or sensing an information notification originating from an EOT device associated with a first train in a geographic area. The information notification includes at least one of traversal information associated with a position of the first train in a track network or an identifier associated with the first train. For example, the HOT device 102 can receive or sense an information notification originating from an EOT device 108 associated with a first train in a geographic area. The information notification can include at least one of traversal information associated with a position of the first train in a track network or an identifier associated with the first train.

The HOT device 102 can receive or sense an information notification originating from an EOT device 108 associated with a first train in a geographic area based on a known or predicted communication loss between the on-board computer 120*a* and a remote server (e.g., PTC back office computer, dispatcher, etc.).

The information notification can include an operational notification broadcast including operational information for communicating information relevant to an end of the first train to an onboard computer in a head end of the listener train. For example, the HOT device 102 receives or senses an information notification originating from an EOT device 108 associated with a first train in a geographic area. The information notification includes at least one of traversal information associated with a position of the first train in a track network or an identifier associated with the first train.

The information notification can include an inter-train warning message. For example, the information notification can include a warning portion for communicating warning information relevant to one or more trains within a threshold of the first train. The inter-train warning message is directed to the listener train. For example, train 20 includes a computer (e.g., on-board computer 120*a*, EOT device 108, HOT device 106, etc.) to configure the warning information to include particular information. The particular information is included because it is relevant to the listener train, a railway occupied by the listener train, or the area around the railway occupied by the listener train.

The EOT device 108 can transmit the information notification at a predetermined time (e.g., randomly, periodically, scheduled, based on an event, etc.). The EOT device 108 can re-broadcast messages received from HOT devices on other trains in the railway (e.g., provide information notifications from both trains to get to the HOT devices on both trains, etc.). For example, EOT device 108 broadcasts to the HOT device 102 information based on one or more messages received from one or more trains in the railway.

When the EOT device 108 transmits the inter-train warning message, the inter-train message may not be directed to the listener train. For example, the warning information includes a general event or condition relevant to the listener train and one or more other trains. The HOT device 102 can receive an inter-train message including a general event or condition not relevant to the listener train.

The HOT device can determine an action based on the general event or condition. For example, the action is based on comparing at least one of the general event or condition to information received and sensed by the listener train to determine a warning alert.

As shown in FIG. 2, at step 204, process 200 includes identifying the first train based on at least one of a position of the first train or an identifier. For example, the HOT device 102 can identify the first train in a railway based on at least one of the position of the first train or the identifier associated with the first train. The HOT device 102 can identify the first train in a railway occupied by the listener train based on the at least one position of the first train or the at least one identifier associated with the first train. For example, the HOT device 102 identifies the first train based on an information notification including a position of a first train in a railway.

The HOT device can forward the information notification to the on-board computer 120*a* before identifying the first train. The on-board computer 120*a* can identify the first train after receiving the information notification based on at least one of the position of the first train or the identifier associated with the first train. For example, the on-board computer 120*a* identifies the first train based on the information notification including a position or location of a first train in a railway. The on-board computer 120*a* can identify the first train based on one or more events or conditions of the first train.

The HOT device 102 and/or the on-board computer 120*a* can identify the first train based on an operational notification broadcast from the first train (e.g., an intra-train operational notification, message between the first train and the listener train, message between one or more trains in proximity to the first train, etc.). For example, HOT device 102 receives the operational notification broadcast from the first train and identifies the first train based on operational information associated with the one or more events or conditions of the first train. The HOT device 102 or on-board computer 120*a* can receive operational information (e.g., a message, etc.) including data fields. For example, the data fields may include one or more of a message type (e.g., Status, Arm, etc.), an EOT identifier, battery status (e.g., good, weak, dead), battery charge used, brake pipe pressure (e.g., psi, etc.), emergency valve status (e.g., good, fail, etc.), air turbine equipped data (e.g., yes or no), motion status (e.g., stopped, moving, etc.), marker light status (e.g., on or off), GPS status (e.g., available, unavailable, etc.), location (e.g., latitude, longitude, etc.), location confidence/uncertainty, speed, heading (e.g., orientation to true/magnetic north, etc.).

As shown in FIG. 2, at step 206, process 200 includes determining one or more events or conditions of the first train in the track network based on the information notification. For example, the on-board computer 120*a* can determine one or more events or conditions of the first train in the track network based on the information notification. The on-board computer 120*a* can determine one or more events or conditions of the first train in the track network after the on-board computer 120*a* identifies the first train in the railway. The on-board computer 120*a* can determine one or more events or conditions of the first train in the track network after the HOT device 102 identifies the first train in the railway.

The HOT device 102 can forward the information notification to the on-board computer 120*a* after identifying the first train. The HOT device 102 can forward these messages to the on-board computer 120*a* (e.g., PTC system, etc.) after processing. For example, the HOT device 102 processes the information notification to determine at least one field to forward to the on-board computer (e.g., PTC system, etc.). The HOT device can forward at least the EOT identifier and location information to the on-board computer 120*a*.

The on-board computer 120*a* can determine the information notification comprises an operational notification broadcast (e.g., communicated to any train in the railway, etc.) from the first train and including operational information associated with the one or more event or conditions of the first train.

The on-board computer 120*a* can determine an action based on the one or more events or conditions of the first train and an event or condition in the listener train. For example, the on-board computer 120*a* determines the first train is traveling on a route including at least one first track in a railway of a current route of the listener train. The on-board computer 120*a* can compare train information of the first train with train information of the listener train. For example, the on-board computer 120*a* compares at least one of a distance to the first train, a speed of the first train, and/or a condition of the at least first one track in the railway.

The on-board computer 120*a* can determine a safe action for travel based on comparing train information.

The on-board computer 120*a* can determine a safe action for travel based on comparing train information before controlling the train based on the safe action.

The on-board computer 120*a* can determine one or more events or conditions based on at least one parameter. For example, the on-board computer 120*a* determines one or more events or conditions based on the at least one parameter associated with at least one of track geometry, weather conditions, track conditions, location or position coordinates, velocity or acceleration of the listener train, and/or velocity or acceleration of one or more other trains.

As shown in FIG. 2, at step 208, process 200 includes generating an updated operation of the listener train including one or more actions. The updated operation is based on the one or more events or conditions associated with the first train. For example, the on-board computer 120*a* can generate an updated operation of the listener train including one or more actions. For example, on-board computer 120*a* generates an updated operation based on the one or more events or conditions associated with the first train. The on-board computer 120*a* and/or HOT device 102 can alert an operator as to at least one action associated with avoiding a hazard in the track network. The on-board computer 120*a* and/or HOT device 102 can alert an operator as to at least one action associated with avoiding a hazard in the track network before controlling a movement of the listener train based at least partially on the at least one action.

The on-board computer 120*a* and/or HOT device 102 can alert an operator by displaying, by a display connected to the on-board computer 120*a* and/or HOT device 102, a map including a position or location of the first train. For example, the on-board computer 120*a* and/or HOT device 102 alerts an operator by displaying information about the railway (e.g., a map, speed restriction, occupied track information, etc.) in response to an alert. The on-board computer 120*a* can communicate a plurality of actions to an operator interface onboard a control car of the listener train. For example, on-board computer 120*a* communicates a plurality of actions including the at least one action associated with avoiding the hazard. The on-board computer 120*a* and/or HOT device 102 can receive (e.g., from a train operator with the operator interface, etc.) a selection of at least one of the plurality of actions.

As shown in FIG. 2, at step 210, process 200 includes controlling, by the on-board computer 120*a*, a movement of the listener train based on at least one of the one or more actions. For example, the HOT device 102 can receive or sense an information notification originating from an EOT device 108 associated with a first train in a geographic area. The information notification includes at least one of traversal information associated with a position of the first train in a track network or an identifier associated with the first train. The EOT device 108 can forward the information notification to the on-board computer 120*a*. The on-board computer 120*a* can control the train 10 in relation to train 20 based on the traversal information and/or the identifier associated with the first train (e.g., maintains a safe speed or distance, etc.)

The on-board computer 120*a* can issue a command in response to the selection. For example, the on-board computer 120*a* can perform a braking command. For example, to account for potential communication loss of communication between the on-board PTC system and the PTC back office, the on-board computer 120*a* (e.g., PTC system) performs the braking command decisions described in the use cases above.

Figure 3A:
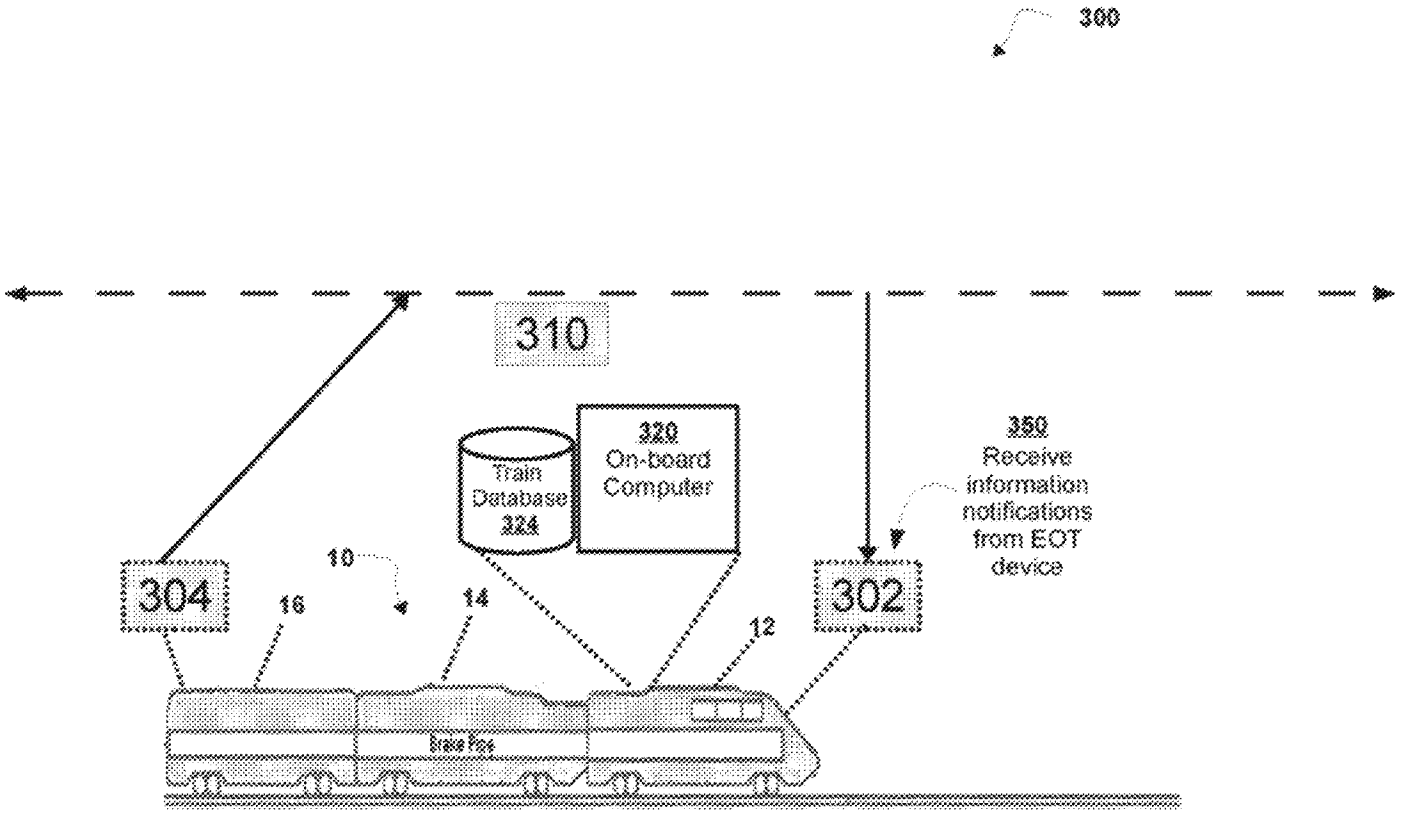
FIGS. 3A-3C illustrate an implementation of an embodiment of a process disclosed herein.
Figure 3B:
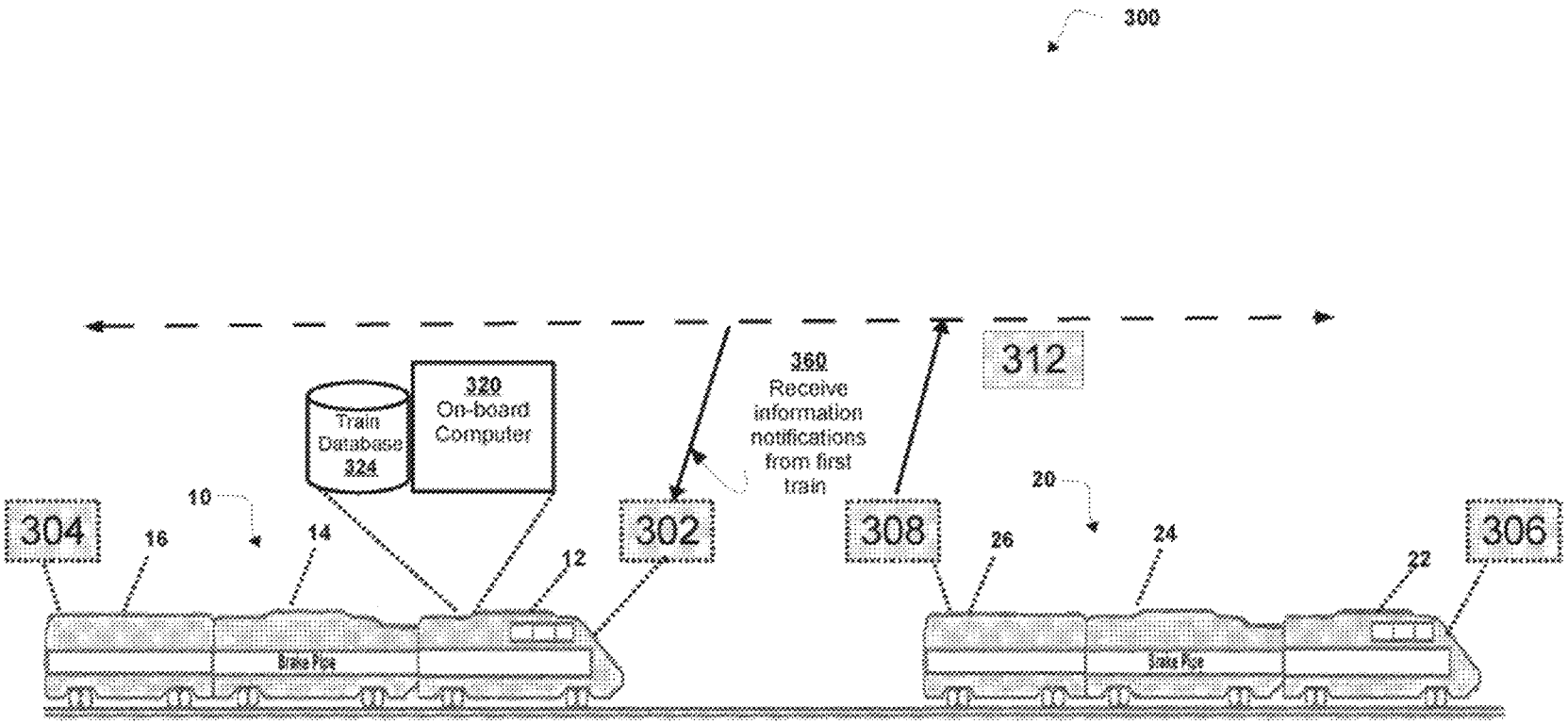

Referring now to FIGS. 3A-3B, FIGS. 3A-3B are diagrams of an overview of an implementation 300 relating to a train-to-train warning system 100. As shown in FIGS. 3A-3B, implementation 300 may include a train 10, a HOT device 302, an EOT device 304, an on-board computer 320 *a*, and a train database 324. The HOT device 302 and EOT device 304 may be the same or similar to HOT device 102 and EOT device 104, respectively. The on-board computer 320 may be the same or similar to on-board computer 120*a*.

As shown by reference number 350 in FIG. 3A, implementation 300 includes receiving information notifications. For example, EOT device 304 generates and/or transmits an information notification 310 via a trainlink (e.g., an omnidirectional signal, RF signal, etc.). HOT device 302 then receives the information notification 310 to the EOT device 304 (e.g., via the trainlink, etc.). For example, HOT device receives the information notification 310 from EOT device 304 associated with a position or location of end of train railcar 16 at a rear of the train 10.

As shown by reference number 360 in FIG. 3B, implementation 300 includes receiving information notifications from a first train 20 in the railway. For example, EOT device 308 generates and/or transmits an information notification 312 via an omnidirectional signal. The HOT device 302 can receive the information notification 312 from EOT device 308 while remaining armed to the EOT device 304. For example, HOT device receives information notification 312 including location information associated with EOT device 308 at an end of train railcar 26.

The EOT device 308 can transmit an information notification 312 via a trainlink (e.g., an omnidirectional signal, RF signal, etc.). For example, HOT device 302 receives the information notification 312 via the trainlink while armed to the EOT device 304. For example, HOT device 302 receives information notification 312 and updates the on-board computer 320.

Figure 3C:
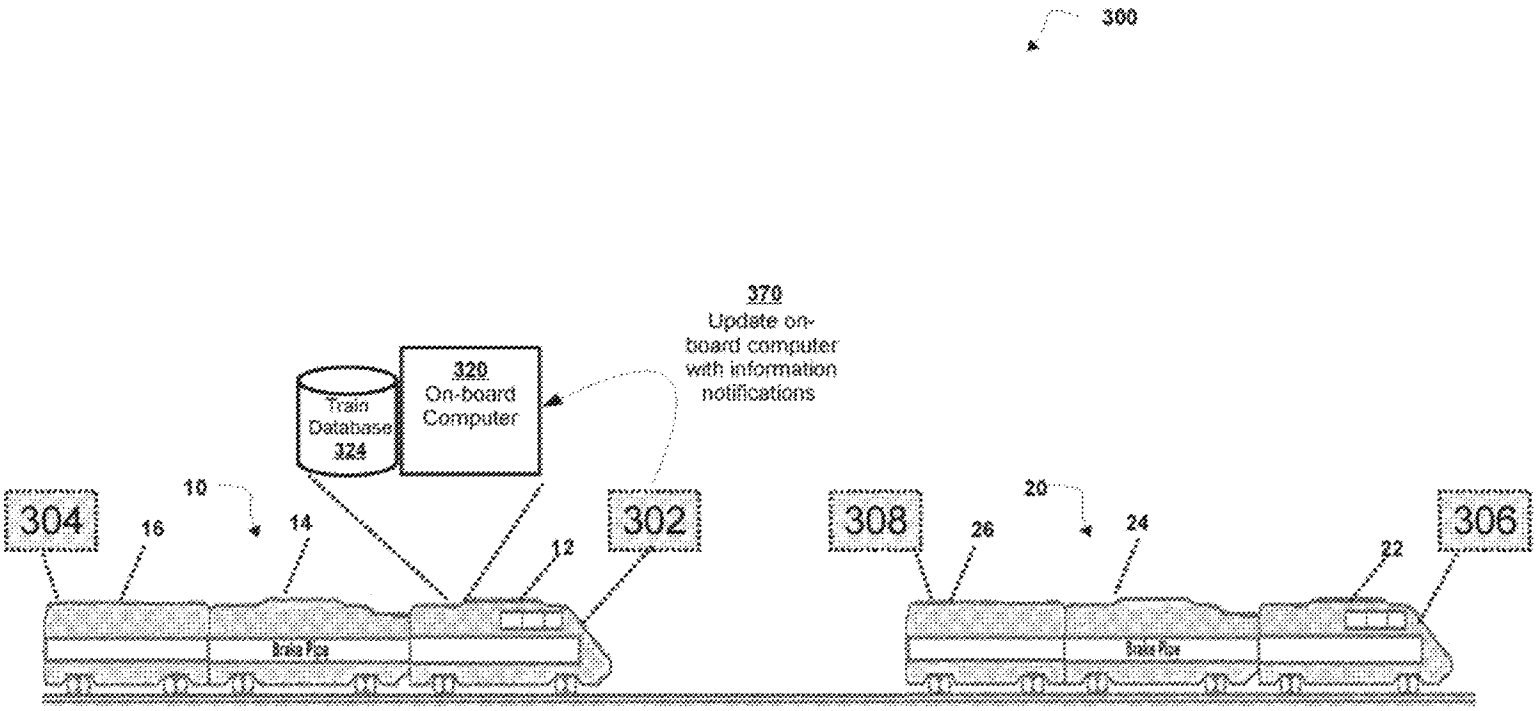

As shown by reference number 370 in FIG. 3C, implementation 300 includes updating an on-board computer 320 with information notifications. For example, EOT device 308 generates and/or transmits an information notification 312 via an omnidirectional signal, HOT device 302 receives the information notification 312 from EOT device 308 while remaining armed to EOT device 304 (e.g., information notifications 312 of EOT device 308, information notifications 310 of EOT device 304, etc.), and HOT device 302 communicates (e.g., transmits, sends, stores, etc.) to onboard computer 320. For example, HOT device 302 communicates information notification 312 identifying a location of at least a portion of train 20 in an unsafe location to an onboard computer and/or a remote computer for controlling train 10. The onboard computer 320 can control a movement of the train based on the information notification 312.

The train-to-train warning system may further include a web portal. The web portal may be an interface through which railroads may define information notifications. The web portal may display alerts and report events associated with one or more information notifications.

The train-to-train warning system may further include a computer application, such as a smart phone application, through which users may receive push notifications. The push notifications may depend on the role of the users, such as whether the users are associated with the railroad for the train 10 or is associated with another specified entity, such as a first responder.

The inventive subject matter described herein also may be used in connection with vehicles that are not rail vehicles, such as automobiles, trucks, buses, mining vehicles, and the like. For example, at least one of the rail vehicle systems 10 and/or 20 described above may be an automobile, truck, bus, mining vehicle, or the like. The HOT device and EOT device described above may be referred to as communication devices onboard each of the first and second vehicle systems. As one example, the information notification that is communicated (as described above) can be received from a first vehicle system (with the notification received as a second vehicle system). The first and/or second vehicle systems may not be rail vehicles. The information notification can include traversal information associated with a position of the first vehicle system and/or an identifier of the first vehicle system. The information notification also can include a warning that indicates that the second vehicle system is moving too close to the first vehicle system and/or that the first vehicle system and the second vehicle system are headed toward the same intersection (such that the vehicle systems may occupy the intersection at the same time and potentially collide with each other). The onboard computer of the first vehicle system can examine the information included in this notification and determine whether a response should be sent based on the information notification. For example, the onboard computer of the first vehicle system can determine whether the locations, headings, speeds, etc., of the first and second vehicle systems indicate that a collision may occur between the vehicle systems if the vehicle systems continue moving as the vehicle systems are currently moving. The onboard computer can communicate a response from the first vehicle system to the second vehicle system. This response can be generated and communicated based on the information notification received from the second vehicle system. The response can command the second vehicle system to slow down, stop movement, and/or change directions (e.g., by moving onto another route) to avoid a collision with the first vehicle system.

Figure 4:
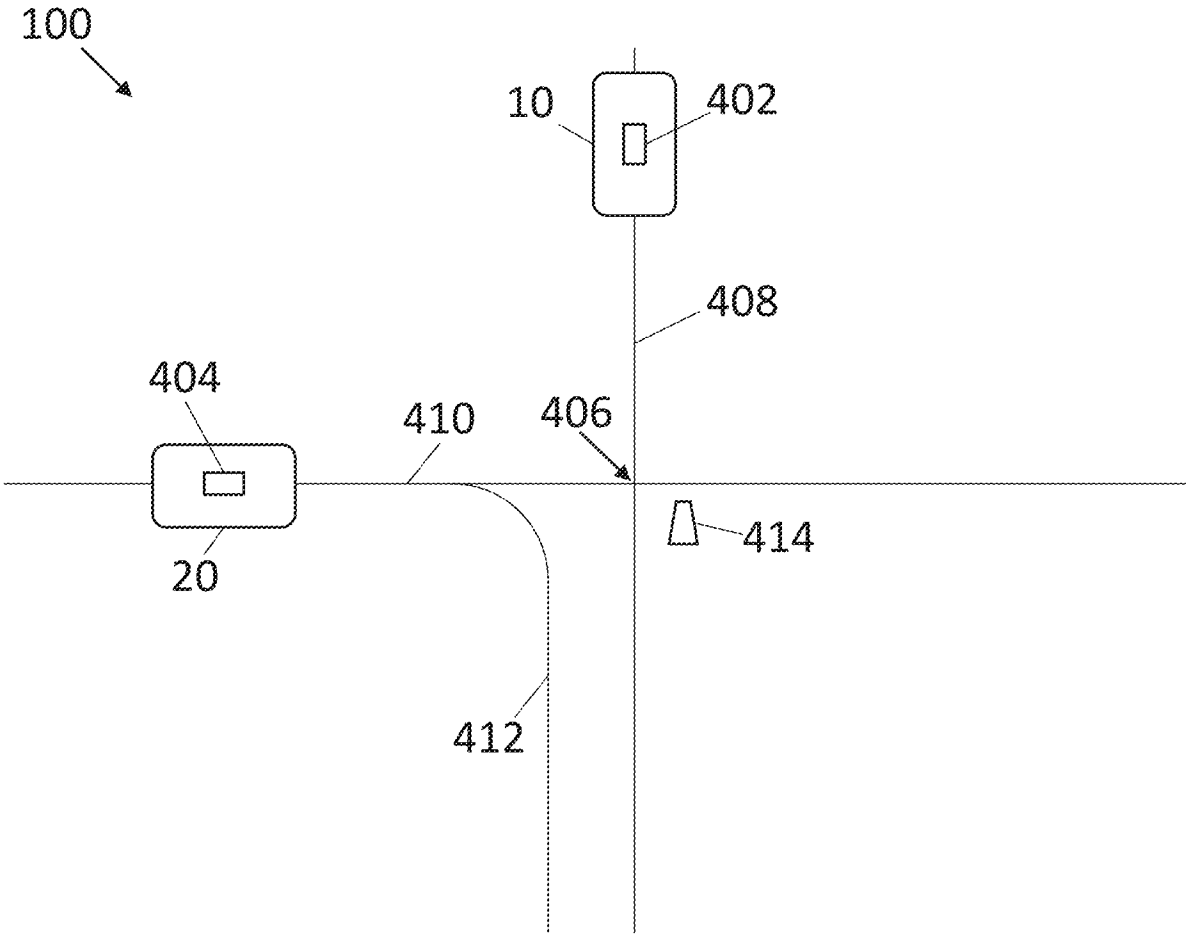
FIG. 4 illustrates another example of the vehicle warning system described above.

FIG. 4 illustrates another example of the vehicle warning system 100 described above. A communication device 402 onboard a first vehicle system 10 can represent the HOT device 102, the EOT device 104, or another device that can determine the location and/or movements of the first vehicle system (e.g., a GPS or GNSS receiver). A communication device 404 onboard a second vehicle system 20 can represent the other of the HOT device 102 or the EOT device 104, or another device that can determine the location and/or movements of the first vehicle system (e.g., a GPS or GNSS receiver). During movement of the vehicle systems, the location, heading, and/or speed of the first vehicle system may be communicated from the communication device of the first vehicle system to the communication device onboard the second vehicle system that is within a designated proximity (e.g., distance) of a route 408 being traveled upon by the first vehicle system and/or a crossing or intersection 406 between the route traveled upon by the first vehicle system and a route 410 being traveled upon by the second vehicle system.

The first vehicle system may be a train and the second vehicle system may be a non-rail vehicle system. The location, heading, and/or speed of the rail vehicle system may be tracked and communicated from the rail vehicle system to the non-rail vehicle system responsive to the non-rail vehicle system coming within a designated distance of the track being traveled upon by the rail vehicle system and/or a crossing between the track and a route (e.g., road) being traveled upon by the non-rail vehicle system. As one example, the communication device onboard the rail vehicle system may repeatedly and wirelessly broadcast the location, heading, and/or speed of the rail vehicle system. The communication devices onboard other vehicle systems (e.g., automobiles, buses, trucks, mining vehicles, or the like) that are within a wireless communication range of the communication device of the rail vehicle system can receive the location, heading, and/or speed of the rail vehicle system. The wireless communication range of the communication device onboard the rail vehicle system can define or be the designated distance described above.

The communication device and on-board computer **102*b* of the non-rail vehicle system that receives the broadcast signals from the rail vehicle system can determine whether to slow down, stop, and/or change heading. For example, an automobile approaching the crossing may receive a signal from the rail vehicle system indicating that the rail vehicle system is approaching the crossing. This crossing can be a grey crossing or another type of crossing. The onboard computer of the automobile may determine (based on the location, heading, and/or speed of the automobile) that the automobile needs to either stop, slow down, or change direction (e.g., turn) to avoid reaching the crossing while the crossing is occupied by the rail vehicle system. The onboard computer of the automobile can then display instructions or a warning to the operator (e.g., driver) of the automobile, and/or can automatically control the automobile to slow down, stop, or change direction to avoid reaching the crossing at the same time that the crossing is occupied by the rail vehicle system. With respect to changing direction, the on-board computer of the automobile can control steering of the automobile to leave the route 410 and begin moving on another route 412 that does not include the intersection 406 between the routes 408, 410**.

Conversely, the first vehicle system may be a non-rail vehicle system and the second vehicle system may be the rail vehicle system. For example, the location, heading, and/or speed of the non-rail vehicle system may be tracked and communicated from the non-rail vehicle system to the rail vehicle system responsive to the rail vehicle system coming within a designated distance of the route being traveled upon by the non-rail vehicle system and/or a crossing between the track and a route (e.g., road) being traveled upon by the rail vehicle system. The communication device onboard the non-rail vehicle system may repeatedly and wirelessly broadcast the location, heading, and/or speed of the non-rail vehicle system. The communication devices onboard the rail vehicle systems that are within the wireless communication range of the communication device of the non-rail vehicle system can receive the location, heading, and/or speed of the non-rail vehicle system. The on-board computers of the rail vehicle systems that receive the broadcast signals from the non-rail vehicle system can determine whether to slow down, stop, and/or change heading. For example, a train approaching a crossing may receive a signal from an automobile or truck indicating that the automobile or truck is approaching the crossing. The onboard computer of the train may determine (based on the location, heading, and/or speed of the train) that the train needs to either stop or slow down to avoid reaching the crossing while the crossing is occupied by the automobile or truck. The onboard computer of the train can then display instructions or a warning to the operator of the train, and/or can automatically control the train to slow down or stop.

Optionally, the warning system may include a beacon device 414 that communicates (e.g., broadcasts) warnings to vehicle systems. The beacon device can include the communication device and/or computer described herein, but may be a stationary device (while the communication devices and computers onboard the vehicle systems may move with the vehicle systems). The beacon device can receive the signals communicated by one or more of the vehicle systems and broadcast the signals to warn other vehicle systems. For example, as the rail vehicle system moves toward the crossing, the rail vehicle system can communicate a signal to the beacon device that notifies the beacon device that the rail vehicle system is approaching the crossing. This signal can inform the beacon device of the location, heading, and/or speed of the rail vehicle system. The beacon device can broadcast a warning signal to notify other vehicle systems in the area of the crossing of the approaching rail vehicle system. For example, automobiles within a wireless range of the beacon device can receive the signal that is repeatedly broadcast by the beacon device. This signal can warn the automobiles of the rail vehicle system approaching the crossing. The on-board computers of the automobiles can warn the operators and/or change movement of the automobiles (as described above) in response to receiving the signal (if such warning or change in movement is needed to prevent a collision or the automobiles arriving at the crossing while the rail vehicle system is in the crossing).

Optionally, the vehicle systems that communicate with each other directly or indirectly (via the beacon device) can be non-rail vehicle systems. For example, automobiles, trucks, buses, mining vehicles, etc., can include the onboard computers and communication devices described herein. These vehicle systems can communicate with each other to notify each other of the other vehicle system movements (e.g., locations, speeds, headings, etc.). The vehicle systems can control their movements based on the reported movements of the other vehicle systems. For example, onboard computers can warn operators or drivers of a large number of vehicle systems nearby or ahead, and the onboard computers or operators/drivers can control the vehicle systems to take other routes to avoid traffic congestion. Some known software applications operating in onboard computers of automobiles or trucks and/or operating on mobile phones or other devices carried in automobiles or trucks track locations and movements of the vehicle systems and notify an off-board location (e.g., one or more servers) of the locations and movements of many vehicle systems. This information is shared with the software applications to assist drivers in finding shorter and/or faster routes, and in avoiding areas of increased traffic congestion. But, these software applications rely on the current or past locations and movements of vehicles, and not on the planned or upcoming movements of the vehicles.

One embodiment of the subject matter described herein examines movements of the vehicle systems to determine where the vehicle systems are headed toward (e.g., the intersection described above, another vehicle system, etc.). Using this information, the onboard computers of the vehicle systems can instruct drivers/operators to change movement of the vehicle systems or can automatically change movement of the vehicle systems to reduce or avoid traffic congestion. For example, several vehicle systems can use route navigation software operating on onboard computers to plan routes to destination locations. The communication devices onboard the vehicle systems can share the planned routes, current locations, and/or moving speeds with each other. The onboard computers of the vehicle systems can use the planned movements of other vehicle systems, along with current locations and movements of the vehicle systems, to plan and/or change their own movements. For example, a first automobile may receive the planned routes of several additional automobiles from the additional automobiles. The first automobile may determine, from these planned routes, current locations, and/or speeds of the additional automobiles, that the first automobile will encounter traffic congestion in an upcoming route. This may be due to more than a threshold density of the additional automobiles being within an area that the first automobile is headed toward, a rail vehicle system planning on being stopped at a crossing that the first automobile and/or the additional automobiles are planning on moving through, etc. The onboard computer of the first automobile may instruct the driver to change routes and/or automatically change routes to avoid the traffic congestion using this information. This allows the vehicle systems to look at planned, upcoming movements of other vehicle systems, and not just the live, real time, or current movements of other vehicle systems, to plan movements.

In one example of the subject matter described herein, a method is provided that includes receiving an information notification from a first vehicle system at a second vehicle system. The information notification includes traversal information associated with a position of the first vehicle system and/or an identifier associated with the first vehicle system. The information notification also including a warning that indicates of the second vehicle system is moving too close to the first vehicle system and/or the first vehicle system and the second vehicle system are headed toward an intersection. The method also includes determining that a response should be sent based on the information notification and sending the response based on the information notification to the first vehicle system. The response includes a command to slow down or stop to avoid a collision with the first vehicle system.

Optionally, the first vehicle system and/or the second vehicle system is a rail vehicle system.

Optionally, the first vehicle system and/or the second vehicle system is not a rail vehicle system (e.g., is an automobile, mining vehicle, bus, truck, etc.).

Optionally, the information notification is received by the second vehicle system while the second vehicle system is within a designated distance of the first vehicle system.

Optionally, the information notification is received by the second vehicle system while the second vehicle system is within a designated distance of the intersection between a first route being traveled by the first vehicle system and a second route being traveled by the second vehicle system.

Optionally, the information notification is received by the second vehicle system from a stationary beacon device disposed at the intersection.

In another example of the subject matter described herein, a system includes a communication device configured to be disposed onboard a first vehicle system. The communication device is configured to receive an information notification from a second vehicle system. The information notification includes traversal information associated with a position of the second vehicle system and/or an identifier associated with the second vehicle system. The information notification can include a warning that indicates the first vehicle system is moving too close to the second vehicle system (e.g., the vehicle systems are within a threshold distance of each other or will be within the threshold distance of each other within a designated period of time if the vehicle systems continue moving on current headings and at current speeds). Optionally, the information notification can additionally or alternatively indicate that the first vehicle system and the second vehicle system are headed toward an intersection. The system also includes one or more processors configured to determine that a response should be sent to the second vehicle system based on the information notification. The one or more processors are configured to direct the communication device to send the response based on the information notification. The response includes a command to slow down or stop to avoid a collision with the first vehicle system.

Optionally, the first vehicle system and/or the second vehicle system is a rail vehicle system.

Optionally, the first vehicle system and/or the second vehicle system is not a rail vehicle system.

Optionally, the communication device is configured to receive the information notification while the first vehicle system is within a designated distance of the second vehicle system.

Optionally, the communication device is configured to receive the information notification while the first vehicle system is within a designated distance of the intersection between a first route being traveled by the first vehicle system and a second route being traveled by the second vehicle system.

Optionally, the communication device is configured to receive the information notification from a stationary beacon device disposed at the intersection.

In another example of the subject matter described herein, a method includes monitoring movement of a rail vehicle system along a track, monitoring movement of a non-rail vehicle system along a route that intersects the track, determining (onboard the rail vehicle system and/or the non-rail vehicle system) whether the movement of the rail vehicle system and the movement of the non-rail vehicle system will result in the rail vehicle system and the non-rail vehicle system occupying an intersection between the track and the route at a same time, and communicating a signal from the one or more of the rail vehicle system or the non-rail vehicle system to another of the one or more of the rail vehicle system or the non-rail vehicle system. The signal instructs at least one of the rail vehicle system or the non-rail vehicle system to stop, slow down, or move onto another track or another route.

Optionally, (a) determining whether the movement of the rail vehicle system and the movement of the non-rail vehicle system will result in the rail vehicle system and the non-rail vehicle system occupying an intersection between the track and the route at the same time and (b) communicating the signal occurs onboard the rail vehicle system.

Optionally, (a) determining whether the movement of the rail vehicle system and the movement of the non-rail vehicle system will result in the rail vehicle system and the non-rail vehicle system occupying an intersection between the track and the route at the same time and (b) communicating the signal occurs onboard the non-rail vehicle system.

Optionally, determining whether the movement of the rail vehicle system and the movement of the non-rail vehicle system will result in the rail vehicle system and the non-rail vehicle system occupying an intersection between the track and the route at the same time occurs onboard the rail vehicle system and the signal is communicated to a stationary beacon device.

Optionally, the signal is communicated from the rail vehicle system to the stationary beacon device, and from the stationary beacon device to the non-rail vehicle system.

Optionally, the method also includes automatically changing the movement of the at least one of the rail vehicle system or the non-rail vehicle system responsive to receiving the signal.

Optionally, automatically changing the movement includes the non-rail vehicle system moving onto another route that does not intersect with the track.

Optionally, automatically changing the movement includes the non-rail vehicle system slowing down or stopping.

As used herein, the terms "processor" and "computer," and related terms, e.g., "processing device," "computing device," and "controller" may be not limited to just those integrated circuits referred to in the art as a computer, but refer to a microcontroller, a microcomputer, a programmable logic controller (PLC), field programmable gate array, and application specific integrated circuit, and other programmable circuits. Suitable memory may include, for example, a computer-readable medium. A computer-readable medium may be, for example, a random-access memory (RAM), a computer-readable non-volatile medium, such as a flash memory. The term "non-transitory computer-readable media" represents a tangible computer-based device implemented for short-term and long-term storage of information, such as, computer-readable instructions, data structures, program modules and sub-modules, or other data in any device. Therefore, the methods described herein may be encoded as executable instructions embodied in a tangible, non-transitory, computer-readable medium, including, without limitation, a storage device and/or a memory device. Such instructions, when executed by a processor, cause the processor to perform at least a portion of the methods described herein. As such, the term includes tangible, computer-readable media, including, without limitation, non-transitory computer storage devices, including without limitation, volatile and non-volatile media, and removable and non-removable media such as firmware, physical and virtual storage, CD-ROMS, DVDs, and other digital sources, such as a network or the Internet.

The singular forms "a", "an", and "the" include plural references unless the context clearly dictates otherwise. "Optional" or "optionally" means that the subsequently described event or circumstance may or may not occur, and that the description may include instances where the event occurs and instances where it does not. Approximating language, as used herein throughout the specification and claims, may be applied to modify any quantitative representation that could permissibly vary without resulting in a change in the basic function to which it may be related. Accordingly, a value modified by a term or terms, such as "about," "substantially," and "approximately," may be not to be limited to the precise value specified. In at least some instances, the approximating language may correspond to the precision of an instrument for measuring the value. Here and throughout the specification and claims, range limitations may be combined and/or interchanged, such ranges may be identified and include all the sub-ranges contained therein unless context or language indicates otherwise.

This written description uses examples to disclose the embodiments, including the best mode, and to enable a person of ordinary skill in the art to practice the embodiments, including making and using any devices or systems and performing any incorporated methods. The claims define the patentable scope of the disclosure, and include other examples that occur to those of ordinary skill in the art. Such other examples are intended to be within the scope of the claims if they have structural elements that do not differ from the literal language of the claims, or if they include equivalent structural elements with insubstantial differences from the literal language of the claims.

What is claimed is:

1. A method comprising:

receiving an information notification from a first vehicle system at a second vehicle system, the information notification including at least one of traversal information associated with a position of the first vehicle system or an identifier associated with the first vehicle system, the information notification also including a warning that indicates one or more of the second vehicle system is moving too close to the first vehicle system or the first vehicle system and the second vehicle system are headed toward an intersection;

determining that a response should be sent based on the information notification; and sending the response based on the information notification to the first vehicle system, the response including a command to (a) slow down or (b) stop to avoid a collision with the first vehicle system.

2. The method of claim 1, wherein at least one of the first vehicle system or the second vehicle system is a rail vehicle system.

3. The method of claim 1, wherein at least one of the first vehicle system or the second vehicle system is not a rail vehicle system.

4. The method of claim 1, wherein the information notification is received by the second vehicle system while the second vehicle system is within a designated distance of the first vehicle system.

5. The method of claim 1, wherein the information notification is received by the second vehicle system while the second vehicle system is within a designated distance of the intersection between a first route being traveled by the first vehicle system and a second route being traveled by the second vehicle system.

6. The method of claim 1, wherein the information notification is received by the second vehicle system from a stationary beacon device disposed at the intersection.

7. A system comprising:

a communication device configured to be disposed onboard a first vehicle system, the communication device configured to receive an information notification from a second vehicle system, the information notification including at least one of traversal information associated with a position of the second vehicle system or an identifier associated with the second vehicle system, the information notification also including a warning that indicates one or more of the first vehicle system is moving too close to the second vehicle system or the first vehicle system and the second vehicle system are headed toward an intersection; and one or more processors configured to determine that a response should be sent to the second vehicle system based on the information notification, the one or more processors configured to direct the communication device to send the response based on the information notification, the response including a command to (a) slow down or (b) stop to avoid a collision with the first vehicle system.

8. The system of claim 7, wherein at least one of the first vehicle system or the second vehicle system is a rail vehicle system.

9. The system of claim 7, wherein at least one of the first vehicle system or the second vehicle system is not a rail vehicle system.

10. The system of claim 7, wherein the communication device is configured to receive the information notification while the first vehicle system is within a designated distance of the second vehicle system.

11. The system of claim 7, wherein the communication device is configured to receive the information notification while the first vehicle system is within a designated distance of the intersection between a first route being traveled by the first vehicle system and a second route being traveled by the second vehicle system.

12. The system of claim 7, wherein the communication device is configured to receive the information notification from a stationary beacon device disposed at the intersection.

13. A method comprising:

monitoring movement of a rail vehicle system along a track;

monitoring movement of a non-rail vehicle system along a route that intersects the track;

determining, onboard one or more of the rail vehicle system or the non-rail vehicle system, whether the movement of the rail vehicle system and the movement of the non-rail vehicle system will result in the rail vehicle system and the non-rail vehicle system occupying an intersection between the track and the route at a same time; and communicating a signal from the one or more of the rail vehicle system or the non-rail vehicle system to another of the one or more of the rail vehicle system or the non-rail vehicle system, the signal instructing at least one of the rail vehicle system or the non-rail vehicle system to stop, slow down, or move onto another track or another route.

14. The method of claim 13, wherein (a) determining whether the movement of the rail vehicle system and the movement of the non-rail vehicle system will result in the rail vehicle system and the non-rail vehicle system occupying an intersection between the track and the route at the same time and (b) communicating the signal occurs onboard the rail vehicle system.

15. The method of claim 13, wherein (a) determining whether the movement of the rail vehicle system and the movement of the non-rail vehicle system will result in the rail vehicle system and the non-rail vehicle system occupying an intersection between the track and the route at the same time and (b) communicating the signal occurs onboard the non-rail vehicle system.

16. The method of claim 13, wherein determining whether the movement of the rail vehicle system and the movement of the non-rail vehicle system will result in the rail vehicle system and the non-rail vehicle system occupying an intersection between the track and the route at the same time occurs onboard the rail vehicle system and the signal is communicated to a stationary beacon device.

17. The method of claim 16, wherein the signal is communicated from the rail vehicle system to the stationary beacon device, and from the stationary beacon device to the non-rail vehicle system.

18. The method of claim 13, further comprising automatically changing the movement of the at least one of the rail vehicle system or the non-rail vehicle system responsive to receiving the signal.

19. The method of claim 18, wherein automatically changing the movement includes the non-rail vehicle system moving onto another route that does not intersect with the track.

20. The method of claim 18, wherein automatically changing the movement includes the non-rail vehicle system slowing down or stopping.

* * * * *